US009922750B2

(12) United States Patent
Rolink et al.

(10) Patent No.: US 9,922,750 B2
(45) Date of Patent: Mar. 20, 2018

(54) ELECTRICAL INSULATING PAPER

(71) Applicant: TEIJIN ARAMID B.V., Arnhem (NL)

(72) Inventors: Ben Rolink, Ugchelen (NL); Richard Visser, Arnhem (NL); Frank Diedering, Deventer (NL)

(73) Assignee: TEIJIN ARAMID B.V., Wuppertal (DE)

( * ) Notice: Subject to any disclaimer, the term of this patent is extended or adjusted under 35 U.S.C. 154(b) by 0 days.

(21) Appl. No.: 14/647,286

(22) PCT Filed: Nov. 14, 2013

(86) PCT No.: PCT/EP2013/073782

§ 371 (c)(1),
(2) Date: May 26, 2015

(87) PCT Pub. No.: WO2014/079761

PCT Pub. Date: May 30, 2014

(65) Prior Publication Data

US 2015/0318078 A1 Nov. 5, 2015

(30) Foreign Application Priority Data

Nov. 23, 2012 (EP) ..... 12193957

(51) Int. Cl.
*H01B 3/52* (2006.01)
*D21H 13/26* (2006.01)
*D21H 13/10* (2006.01)

(52) U.S. Cl.
CPC ..... *H01B 3/52* (2013.01); *D21H 5/20* (2013.01)

(58) Field of Classification Search
CPC ..... D21H 5/20; D21H 13/26; D21H 13/20; D21H 13/22; D21H 13/24; H01B 3/52
See application file for complete search history.

(56) References Cited

U.S. PATENT DOCUMENTS 4,698,267 A * 10/1987 Tokarsky ..... D21H 13/26 162/146
4,729,921 A * 3/1988 Tokarsky ..... D21H 13/26 162/146
4,888,091 A 12/1989 Nollen et al.
5,026,456 A 6/1991 Hesler et al.
8,168,039 B2 * 5/2012 Levit ..... D21H 13/26 162/157.3
8,211,272 B2 * 7/2012 Levit ..... C09K 3/1028 106/36
9,073,290 B2 * 7/2015 Levit ..... H01B 3/305
9,194,061 B2 * 11/2015 Hendriks ..... D01F 6/605
2004/0089432 A1 * 5/2004 Levit ..... C08J 5/04 162/157.3
2005/0230072 A1 * 10/2005 Levit ..... D21H 13/26 162/146
2007/0087178 A1 * 4/2007 Hendriks ..... D01F 6/605 428/292.1
2007/0137818 A1 * 6/2007 Levit ..... C09K 3/1028 162/146
2008/0107959 A1 * 5/2008 Ishino ..... H01M 2/162 429/129
2010/0212851 A1 * 8/2010 Levit ..... C09K 3/1028 162/157.3
2013/0277089 A1 * 10/2013 Rolink ..... C08J 5/06 174/110 R
2014/0184371 A1 * 7/2014 Harmer ..... H01B 3/303 336/58
2015/0056429 A1 * 2/2015 Kawka ..... F16L 59/029 428/212
2015/0318078 A1 * 11/2015 Rolink ..... D21H 5/20 162/138
2016/0060461 A1 * 3/2016 David ..... C08J 5/048 525/432
2016/0076201 A1 * 3/2016 Wodetzki ..... D21H 13/26 162/9
2016/0160444 A1 * 6/2016 Tiecken ..... A47C 31/001 428/474.4
2017/0030020 A1 * 2/2017 Adjei ..... D21H 7/72

FOREIGN PATENT DOCUMENTS

CN 101872852 A 10/2010
CN 102517976 A 6/2012
JP S59228059 A 12/1984
JP 04228696 A * 8/1992
JP 2000034693 A * 2/2000
KR 20140040096 A * 4/2014 ..... C08J 5/06
KR 20150087248 A * 7/2015 ..... H01B 3/52
WO 2005/103376 A1 11/2005

(Continued)

OTHER PUBLICATIONS

Research Disclosure of Jun. 1992, anonymously disclosed.*
Jan. 13, 2014 International Search Report issued in International Patent application No. PCT/EP2013/073782.
Jan. 13, 2014 International Written Opinion issued in International Patent Application No. PCT/EP2013/073782.
Jun. 28, 2016 Office Action issued in Chinese Patent Application No. 2013-80061049.1.
Sep. 30, 2017 Office Action issued in Chinese Application No. 201380061049.1.
Gailun, Zhijiang Zaozhi. "Introduction to Pulping and Papermaking". Jan. 2012; pp. 143-147.

*Primary Examiner* — Jose A Fortuna
(74) *Attorney, Agent, or Firm* — Oliff PLC

(57) ABSTRACT

An electrical insulating paper having 40-80 wt % of aramid fibrid, 10-50 wt % of aramid pulp, and 10-50 wt % of aramid short-cut. The aramid pulp is para-aramid pulp with a length of 0.5-6 mm and has a Schopper Riegler value of 15-85; the aramid fibrid is para-aramid fibrid; and the aramid short-cut is para-aramid short-cut. The paper shows a high dielectric strength and tensile index. A method for manufacturing the paper and an insulated conductor that includes the paper.

12 Claims, No Drawings

(56) References Cited

FOREIGN PATENT DOCUMENTS

| | | | | | |
|---|---|---|---|---|---|
| WO | 2012/093048 | A1 | | 7/2012 | |
| WO | WO 2012093048 | A1 | * | 7/2012 | ..... C08J 5/06 |
| WO | WO 2013033044 | A1 | * | 3/2013 | ..... H01B 3/421 |
| WO | WO 2014079761 | A1 | * | 5/2014 | ..... H01B 3/52 |
| WO | WO 2016103966 | A1 | * | 6/2016 | ..... D21H 13/26 |

* cited by examiner

ELECTRICAL INSULATING PAPER

The invention pertains to electrical insulating paper, to an insulated conductor comprising said paper, to a transformer, generator or electric motor comprising said insulated conductor, and to a method of preparing said paper.

WO2012093048 describes an electrical insulating paper comprising 40-100 wt. % of a para-aramid fibrid, and up to 60 wt. % of at least one of aramid pulp, aramid floc, aramid staple fiber, aramid fibril, meta-aramid fibrid, meta-para-aramid fibrid, thermal conductive fillers, and common paper additives such as fillers such as kaolin, binders, fibers, tackifiers, and adhesives. The paper can be used in insulated conductors and transformers, generators and electric motors made thereof. The papers described in the examples of this application show a high dielectric strength. However, dielectric strength is but one of the parameters which a high-quality El-paper should satisfy. More specifically, El paper should combine a high dielectric strength with a high tensile index, which can be expressed as the product of the dielectric strength and the tensile index. Further, the ease of manufacture of the paper is also an important feature, and especially papers with high fibrid contents may be difficult to manufacture.

There is therefore need for El papers with improved properties and improved ease of manufacture. The present invention provides such a paper. Further advantages of the present invention will become evident from the further specification.

The present invention pertains to an electrical insulating paper comprising 40-80 wt. % of aramid fibrid, 10-50 wt. % of aramid pulp, and 10-50 wt. % of aramid short-cut, the aramid pulp being para-aramid pulp with a length of 0.5-6 mm and a Schopper Riegler of 15-85.

It has been found that a paper meeting the above requirements shows an increased value for the product of the dielectric strength (expressed in kV/mm) and the tensile index (expressed in Nm/g), as compared to systems comprising only two of the cited components, or less than 40 wt. % of aramid fibrid. A paper comprising 100% aramid fibrid shows a higher value for the product of the dielectric strength (expressed in kV/mm) and the tensile index (expressed in Nm/g) than the papers according to the invention, but this paper may be less attractive because it is difficult to manufacture. Additionally, the tear strength of all-fibrid-papers may be insufficient for certain applications.

It is noted that U.S. Pat. No. 5,026,456 describes a high-porosity paper comprising 10-40 wt. % of aramid fibrid, 5-30 wt. % of high temperature resistant floc, and 30-85 wt. % of aramid paper pulp. The aramid paper pulp is pulp obtained from dried aramid paper comprising floc and fibrid, e.g., by wet refining. The aramid fibrid, the floc, and the pulp are all obtained from meta-aramid. It will be evident to the skilled person that high-porosity papers are not suitable for use as electrical insulating paper, because a high porosity is accompanied by a low electric resistance.

In the context of the present specification aramid refers to an aromatic polyamide which is a condensation polymer of aromatic diamine and aromatic dicarboxylic acid halide. Aramids may exist in the meta- and para-form, both of which may be used in the present invention. The use of aramid wherein at least 85% of the bonds between the aromatic moieties are para-aramid bonds is considered preferred. As typical members of this group are mentioned poly(paraphenylene terephthalamide), poly(4,4'-benzanilide terephthalamide), poly(paraphenylene-4,4'-biphenylenedicarboxylic acid amide) and poly(paraphenylene-2,6-naphthalenedicarboxylic acid amide or copoly(para-phenylene/3,4'-dioxydiphenylene terephthalamide). The use of aramid wherein at least 90%, more in particular at least 95%, of the bonds between the aromatic moieties are para-aramid bonds is considered preferred. The use of poly(paraphenylene terephthalamide), also indicated as PPTA is particularly preferred. This applies to all aramid components present in the paper according to the invention.

The paper according to the invention comprises aramid fibrid. Aramid fibrids are known in the art. Within the context of the present specification the term aramid fibrid refers to small, non-granular, non-rigid film-like particles. The film-like fibrid particles have two of their three dimensions in the order of microns, and have one dimension less than 1 micron. In one embodiment, the fibrids used in the present invention have an average length in the range of 0.2-2 mm, and average width in the range of 10-500 microns, and an average thickness in the range of 0.001-1 microns.

In one embodiment, the aramid fibrid comprises less than 40%, preferably less than 30%, of fines, wherein fines are defined as particles having a length weighted length (LL) of less than 250 micron.

Meta-aramid fibrids may be prepared by shear precipitation of polymer solutions into coagulating liquids as is well known from U.S. Pat. No. 2,999,788. Fibrids of wholly aromatic polyamides (aramids) are also known from U.S. Pat. No. 3,756,908, which discloses a process for preparing poly(meta-phenylene isophthalamide) (MPD-I) fibrids. Para-aramid fibrids are made via much later developed high shear processes such as for example described in WO2005/059247, which fibrids are also called jet-spun fibrids.

It is preferred for the aramid fibrid to be para-aramid fibrid. The most suitable papers have been made from para-aramid fibrid with a Schopper-Riegler (SR) value between 50 and 90, preferably between 75 and 85. These fibrids preferably have a specific surface area (SSA) of less than 10 $m^2/g$, more preferably between 0.5 and 10 $m^2/g$, most preferably between 1 and 4 $m^2/g$.

In one embodiment, fibrids are used with a $LL_{0.25}$ of at least 0.3 mm, in particular of at least 0.5 mm, more in particular at least 0.7 mm. In one embodiment the $LL_{0.25}$ is at most 2 mm, more in particular at most 1.5 mm, still more in particular at most 1.2 mm. $LL_{0.25}$ stands for the length weighted length of the fibrid particles wherein particles with a length below 0.25 mm are not taken into account.

The paper according to the invention comprises aramid pulp. Aramid pulp is well known in the art. The pulp is para-aramid pulp.

Aramid pulp may be derived from aramid fibres which are cut to a length of, e.g., 0.5-6 mm, and then subjected to a fibrillation step, wherein the fibers are pulled apart to form the fibrils, whether or not attached to a thicker stem. Pulp of this type may be characterized by a length of, e.g., 0.5-6 mm, and a Schopper-Riegler of 15-85. In some embodiments, the pulp may have a surface area of 4-20 $m^2/g$.

Within the context of the present specification, the term pulp also encompasses fibrils, i.e., "pulp" which predominantly contains the fibrillated part and little or no fiber stems. This pulp, which is sometimes also indicated as aramid fibril, can, e.g., be obtained by direct spinning from solution, e.g. as described in WO2004/099476. In one embodiment the pulp has a structural irregularity expressed as the difference in CSF (Canadian Standard Freeness) of never dried pulp and dried pulp of at least 100, preferably of at least 150.

In one embodiment fibrils are used having in the wet phase a Canadian Standard Freeness (CSF) value less than 300 ml and after drying a specific surface area (SSA) less than 7 $m^2/g$, and preferably a weight weighted length for particles having a length>250 micron (WL 0.25) of less than 1.2 mm, more preferably less than 1.0 mm. Suitable fibrils and their preparation method are described, e.g., in WO2005/059211.

The paper according to the invention comprises aramid shortcut. In one embodiment aramid shortcut is used, which in the present invention are aramid fibres cut to a length of, e.g., 0.5-15 mm, in particular a length of 2 to 10 mm, more in particular 3-8 mm. The aramid shortcut preferably is para-aramid shortcut.

The paper according to the invention comprises 40-80 wt. % of a aramid fibrid, 10-50 wt. % of aramid pulp, and 10-50 wt. % of aramid short-cut. It has been found that it is the presence of all three components which yields a paper with good properties, as is evidenced by an increased value for the product of the dielectric strength (expressed in kV/mm) and the tensile index (expressed in Nm/g).

In one embodiment, the paper comprises at most 70 wt. % of fibrid, or even at most 60 wt. % of fibrid, on the one hand to allow for the presence of larger amount of other components, and on the other hand to increase the manufacturability of the paper. The presence of large amount of fibrid is associated with the a lower manufacturing velocity, because the removal of water from fibrid-containing paper during manufacture is difficult. Further, the tear strength of paper containing a very high amount of fibrid may be insufficient.

In one embodiment, the paper contains at least 15 wt. % of aramid shortcut, more in particular at least 20 wt. %, because this makes for a paper with increased strength. It may be preferred for the paper to contain at most 40 wt. % of shortcut. If the amount of shortcut is too high, the insulating properties may be detrimentally affected. If the amount of shortcut is too low, the properties of the invention will not be obtained.

In one embodiment, the paper contains at least 15 wt. % of pulp. It may be preferred for the paper to contain at most 40 wt. % of pulp, more in particular at most 30 wt. % of pulp. If the amount of pulp is too high, the insulating properties may be detrimentally affected. If the amount of pulp is too low, the properties of the invention will not be obtained.

In one embodiment, the paper comprises 40-60 wt. % of aramid fibrid as described above, 20-40 wt. % of para-aramid shortcut as described above, and 15-30 wt. % of para-aramid pulp as described above.

If so desired, the paper can comprise one or more common papermaking components, such as fillers including mica, clay such as kaolin and bentonite, thermally conductive electrically insulating fillers, minerals, binders, fibers, tackifiers, adhesives, and the like. It may be preferred for the paper to comprise kaolin as additive. It is further preferred to introduce kaolin into the paper by way of the fibrid, e.g., by using kaolin-containing fibrids manufactured by incorporating kaolin into the fibrid during the spinning process, for instance as has been described in WO 2008/122374.

Thermally conductive electrically insulating fillers are known in the art. They are commonly applied in electrical power generators, switching mode power suppliers and signal amplifiers. Examples of such materials can be found in U.S. Pat. No. 4,869,954, and include aluminum nitride, aluminum oxide, boron nitride, magnesium oxide and zinc oxide.

In one embodiment, the paper of this invention has a bulk density of at least 0.7 $g/cm^3$, preferably 0.9 $g/cm^3$ or higher. Papers with bulk densities less than 0.7 $g/cm^3$ were found to have lower dielectrical strength. As a maximum, a value of 1.4 $g/cm^3$ may be mentioned.

In one embodiment, the paper according to the invention has an electric resistance of at least $10^{13}$ Ωcm according to the volume resistivity method of ASTM D-257. Preferably, the resistance is at least $10^{15}$ Ωcm.

In one embodiment, the paper according to the invention has a grammage in the range of 20 to 1000 $g/m^2$, more in particular in the range of 30 to 300 $g/m^2$.

In one embodiment, the paper according to the invention has a thickness in the range of 20 micron to 1 mm, more in particular in the range of 30 to 300 micron.

The invention also relates to a method of making the above electrical insulating papers. In the process according to the invention, a suspension, generally an aqueous suspension, is prepared comprising aramid fibrid, pulp, and shortcut as described above. The suspension is applied onto a porous screen, so as to lay down a mat of randomly interwoven material onto the screen. Water is removed from this mat, e.g., by pressing and/or applying vacuum, followed by drying to make paper. It has appeared that papers with improved properties can be obtained is the dried paper is subjected to a calendering step. Calendering steps are known in the art. They generally involve passing the paper through a set of rolls. It was also found that a further improvement could be obtained if the calendering was performed at elevated temperature, particularly at 100° C. or higher, preferably between 150° C. to 300° C., more preferably between 180 and 220° C., and most preferably between 180 and 200° C.

It may be beneficial for the electrical properties of the paper to subject the fibrid to shear forces, such as in a Waring blender, prior to using it in the papermaking process.

It is common practice in the manufacture of insulated electrical windings, such as those used in electrical motors or in power transformers, to insulate the respective turns of the windings from one another by placing insulating sheet material between the winding turns. Such sheet material insulation is normally only required on high voltage windings or windings having relatively large turns which inherently develop relatively high voltages between the adjacent turns of the winding. The present papers are suitable for insulating conductors and for making transformers, generators, and electric motors. The present invention therefore also pertains to the use of the paper according to the invention in insulated conductors, and to the use of such insulated conductors in transformers, generators, and electric motors. The present invention also pertains to an insulated conductor comprising the paper as described herein or as obtained by the manufacturing method described herein, and to a transformer, generator or electric motor comprising said insulated conductor. In one embodiment, the paper according to the invention is used in rotating electrical equipment, e.g., for lead wire, coil, slot, phase, wedge, and end insulation. In another embodiment the paper according to the invention is used in transformers for turn, layer, barrier, and tap insulation.

It is noted that the embodiments of the paper described herein may be combined with each other in manners clear to the skilled person. All embodiments and properties described for the paper are also applicable to the method for manufacturing the paper, individually or in combination. All embodiments and properties described for the paper are also applicable to the use thereof in any application, individually or in combination.

Experimental

Papermaking Process (General Procedure)

All paper recipes have been made on the Rapid Koethe (RK) handsheet former according to the method of ISO 5269-2. Drying was done using the RK-dryer under vacuum at 95° C. Calendering of the dried papers was done at 10 μm gap control at 200° C. For calendering two steel rollers were used.

The dielectric strength measurements were done according to ASTM D149 97A 920040. The thickness of the papers was measured according to TAPPI 411 om-05 at the position of the dielectric breakdown. This thickness was used in the calculation of the dielectric strength. At least 5 breakdowns for each type of paper were measured to give the average dielectric strength (which is denoted in the Table). Tensile index (TI) and elongation at break (EAB) were determined in accordance with ISO 1924-2. Gurley was determined in accordance with IS05636-5.

Starting materials were as follows:

PPTA fibrid: Twaron® D8016, ex Teijin Aramid, The Netherlands

Short cut PPTA fiber: Twaron® T1000, 6 mm, ex Teijin Aramid, The Netherlands

PPTA pulp: Twaron® 1094, ex Teijin Aramid, The Netherlands

EXAMPLES

Papers were made according to the method of ISO 5269-2 and thereafter calendered according to the general procedure, unless indicated differently. The ingredients for making paper amounted to 1.6 g of material (based on dry weight), resulting in sheets of 50 g/m$^2$. The compositions, grammage, and thickness of the various papers are presented in table 1 below. Ex 1 is a paper according to the invention. Papers A through E are comparative.

TABLE 1

| Composition | | | | | |
|---|---|---|---|---|---|
| Ex | Fibrids [%] | Short Cut [%] | Pulp [%] | Grammage [g/m$^2$] | Thickness [um] |
| Ex 1 | 50 | 30 | 20 | 50 | 49.5 |
| A | 20 | 30 | 50 | 50 | 52.3 |
| B | 50 | 50 | | 50 | 55.0 |
| C | 100 | | | 50 | 48.7 |
| D | 50 | | 50 | 50 | 49.0 |
| E | | 50 | 50 | 50 | 55.6 |

Various properties of these papers were determined, and the results thereof are presented in Table 2 below.

TABLE 2

| Results | | | | | |
|---|---|---|---|---|---|
| Ex | Dielectric Strength [kV/mm] | TI [Nm/g] | EAB [%] | Gurley [Gs] | TI*DiS |
| Ex 1 | 36.2 | 50.6 | 1.5 | 91400 | 1832 |
| A | 19.6 | 37.8 | 1.1 | 1230 | 741 |
| B | 23.4 | 54.4 | 1.9 | 7150 | 1273 |

TABLE 2-continued

| Results | | | | | |
|---|---|---|---|---|---|
| Ex | Dielectric Strength [kV/mm] | TI [Nm/g] | EAB [%] | Gurley [Gs] | TI*DiS |
| C | 67.1 | 69.5 | 3.2 | 1986096 | 4663 |
| D | 44.3 | 31.2 | 2.2 | 30000 | 1382 |
| E | 12.0 | 6.5 | 0.7 | 12 | 78 |

From the results in Table 2 it can be seen that the paper of Example 1, which is according to the invention, shows a high value for the product of the tensile index and the dielectric strength, which makes it suitable for use in various applications. The paper containing fibrids only has a very high value for this parameter, but water removal during manufacture was difficult, and tear strength was low.

The invention claimed is:

1. An electrical insulating paper comprising:

40-80 wt % of aramid fibrid, 10-50 wt % of aramid pulp, and 10-50 wt % of aramid short-cut, wherein the aramid of the aramid pulp consists of para-aramid and wherein the aramid pulp has a length of 0.5-6 mm and has a Schopper Riegler (SR) value of 15-85, and wherein the aramid fibrid has a SR value of 50-90, and/or a specific surface area (SSA) of less than 10 m$^2$/g.

2. The electrical insulating paper according to claim 1, wherein the aramid fibrid is para-aramid fibrid, and/or the aramid short-cut is para-aramid short-cut.

3. The electrical insulating paper according to claim 1, wherein the paper comprises at most 70 wt % of the aramid fibrid.

4. The electrical insulating paper according to claim 1, wherein the paper contains at least 15 wt % of the aramid short-cut.

5. The electrical insulating paper according to claim 1, wherein the paper contains at least 15 wt % of the aramid pulp.

6. The electrical insulating paper according to claim 1, wherein the paper has a bulk density of at least 0.7 g/cm$^3$.

7. The electrical insulating paper according to claim 1, wherein the paper has an electric resistance of at least $10^{13}$ Ωcm according to the volume resistivity method of ASTM D-257.

8. A method for manufacturing the electrical insulating paper according to claim 1, comprising:

preparing a suspension comprising the aramid fibrid, the aramid pulp, and the aramid shortcut, applying the suspension onto a porous screen, so as to lay down a mat of randomly interwoven material onto the porous screen, removing water from the mat by pressing and/or application of a vacuum, and subjecting the mat from which water is removed to a drying step.

9. The method according to claim 8, further comprising subjecting the dried paper to a calendering step.

10. The method according to claim 9, wherein the calendering step is performed at 100° C. or higher.

11. An insulated conductor comprising the paper according to claim 1.

12. A transformer, generator, or electric motor comprising the insulated conductor of claim 11.

* * * * *